US012577797B2

(12) United States Patent
Liou

(10) Patent No.: US 12,577,797 B2
(45) Date of Patent: Mar. 17, 2026

(54) DUAL-HEADED PRY TOOL WITH ROTATABLE HEAD

(71) Applicant: Tang Chou Industrial Co., Ltd., Nantou County (TW)

(72) Inventor: Mou-Tang Liou, Taichung City (TW)

(73) Assignee: Tang Chou Industrial Co., Ltd., Nantou County (TW)

( * ) Notice: Subject to any disclaimer, the term of this patent is extended or adjusted under 35 U.S.C. 154(b) by 336 days.

(21) Appl. No.: 18/341,911

(22) Filed: Jun. 27, 2023

(65) Prior Publication Data

US 2025/0003244 A1 Jan. 2, 2025

(51) Int. Cl.
*E04G 23/08* (2006.01)

(52) U.S. Cl.
CPC ..... *E04G 23/08* (2013.01); *E04G 2023/085* (2013.01)

(58) Field of Classification Search
CPC ... E04G 23/08; E04G 2023/085; B25C 11/00; B66F 15/00
See application file for complete search history.

(56) References Cited

U.S. PATENT DOCUMENTS 5,280,740 A * 1/1994 Ernst ..... B25B 13/461 81/177.7
8,297,156 B2 * 10/2012 Chiu ..... B25G 1/063 81/177.8
8,448,545 B1 * 5/2013 Argyle ..... B25B 23/1427 81/177.85
9,328,749 B2 * 5/2016 Brunneke ..... F16C 11/0695
10,344,488 B2 * 7/2019 Bridges ..... E04G 23/08
2017/0021476 A1 * 1/2017 Carnesi ..... B25G 1/063
2021/0379749 A1 * 12/2021 Liou ..... B25C 11/00
2023/0256584 A1 * 8/2023 Su ..... B66F 15/00 254/12
2025/0002314 A1 * 1/2025 Liou ..... B66F 15/00

FOREIGN PATENT DOCUMENTS

TW M310787 U 5/2007

* cited by examiner

*Primary Examiner* — Seahee Hong
(74) *Attorney, Agent, or Firm* — MUNCY, GEISSLER, OLDS & LOWE, P.C.

(57) ABSTRACT

A dual-headed pry tool with rotatable head includes a first tool component provided with a first tool head and a first pivot connection, and a second tool component provided with a second tool head and a second pivot connection. The second pivot connection is pivotally connected to the first pivot connection. The second tool component is rotatable relative to the first tool component about a pivot axis which extends along a longitudinal direction of the first tool component. Each of the first and the second tool heads has an orientation with respect to the pivot axis, and a relative angle between the orientations of the first and the second tool heads changes as the second tool component rotates relative to the first tool component.

13 Claims, 6 Drawing Sheets

DUAL-HEADED PRY TOOL WITH ROTATABLE HEAD

BACKGROUND OF THE INVENTION

The present invention relates to a pry tool with dual heads and, more particularly, the head is rotatable to various angular orientations.

Taiwan Pat. No. M310787 discloses a structure-improved pry tool. The pry tool includes an elongated shaft and two claws. The shaft is hollow and has a slightly flat cross section. The two claws are solid. A first claw is coupled to a first of two ends of the shaft. The first claw includes a fix end inserted in the hollow of the shaft and welded to the first end of the shaft. A second claw is coupled to a second of the two ends of the shaft. The second claw includes a fix end inserted in the hollow of the shaft and welded to the second end of the shaft.

When using such pry tool, users often use one hand to grip on the claw not used in order to apply force efficiently. The users, however, are easily scratched by the flat and sharp corners of the claw.

The present invention is, therefore, intended to obviate or at least alleviate the problems encountered in the prior art.

SUMMARY OF THE INVENTION

A dual-headed pry tool with rotatable head includes a first tool component provided with a first tool head useful for prying objects at a first end thereof and a first pivot connection at a second end thereof respectively, and a second tool component provided with a second tool head useful for prying objects at a first end thereof and a second pivot connection at a second end thereof respectively. The second pivot connection is pivotally connected to the first pivot connection to allow the first and the second tool components to pivotally connect with each other. The second tool component is rotatable relative to the first tool component about a pivot axis which extends along a longitudinal direction between the first and the second ends of the first tool component. Each of the first and the second tool heads has an orientation with respect to the pivot axis, and a relative angle between the orientations of the first and the second tool heads changes as the second tool component rotates relative to the first tool component.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing other structures, methods and systems for carrying out the several purposes of the present invention. It is important, therefore, that the claims be regarded as including such equivalent constructions insofar as they do not depart from the spirit and scope of the present invention.

Further, the purpose of the abstract is to enable the public generally, and especially scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
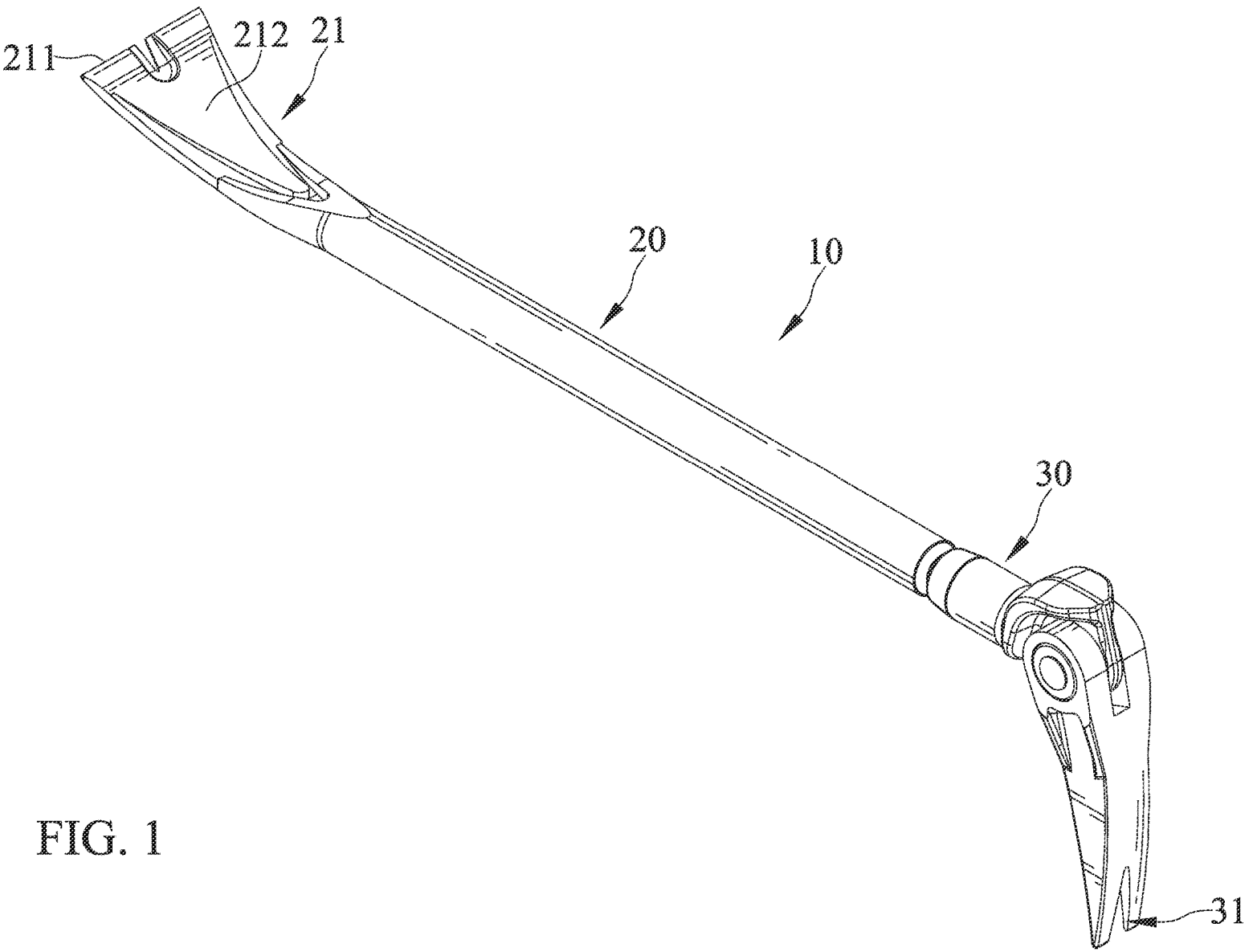
FIG. 1 is a perspective view of a dual-headed pry tool with rotatable head according to the present invention.
Figure 2:
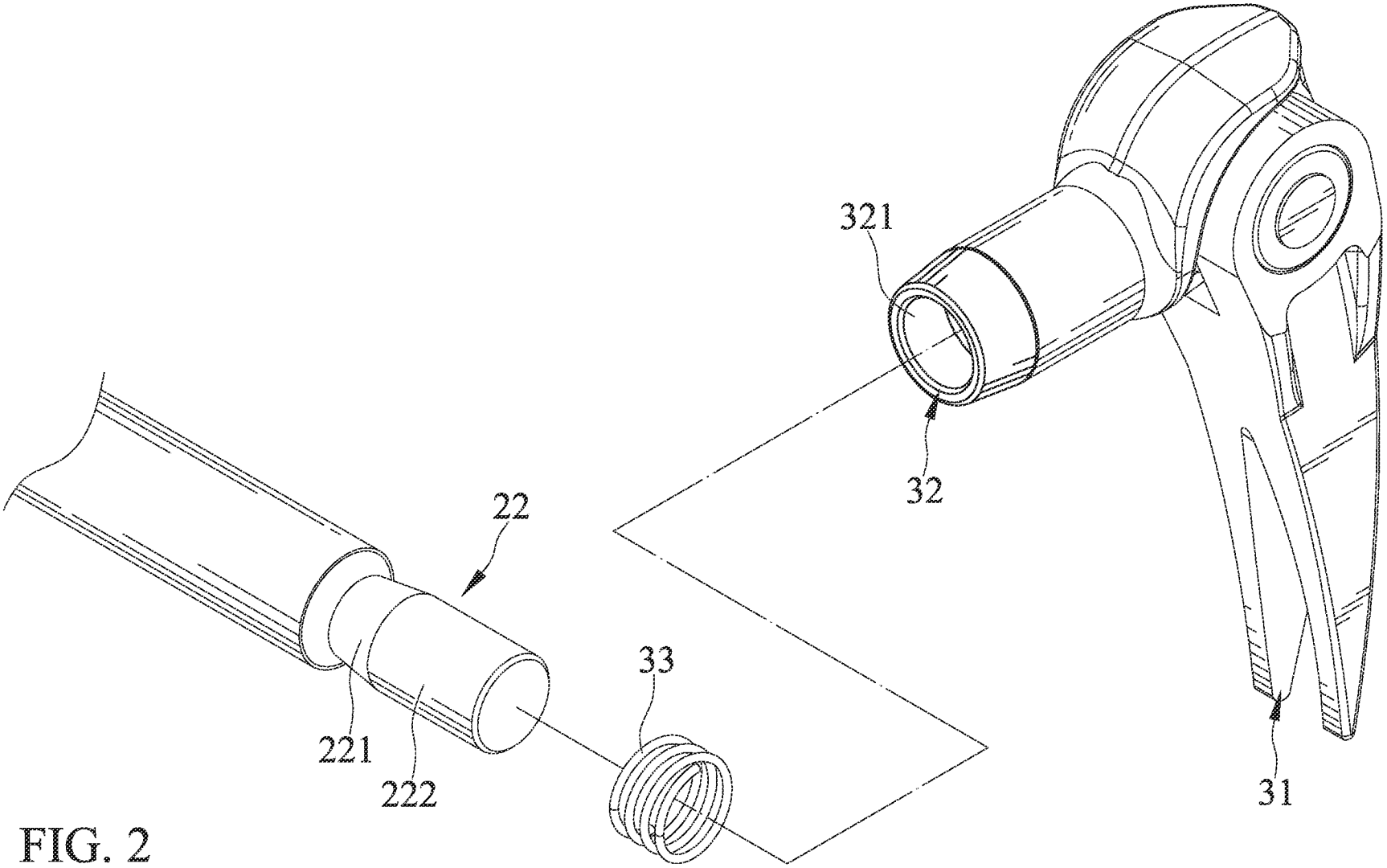
FIG. 2 is an exploded perspective view of a rotatable head of the dual-headed pry tool of FIG. 1.
Figure 3:
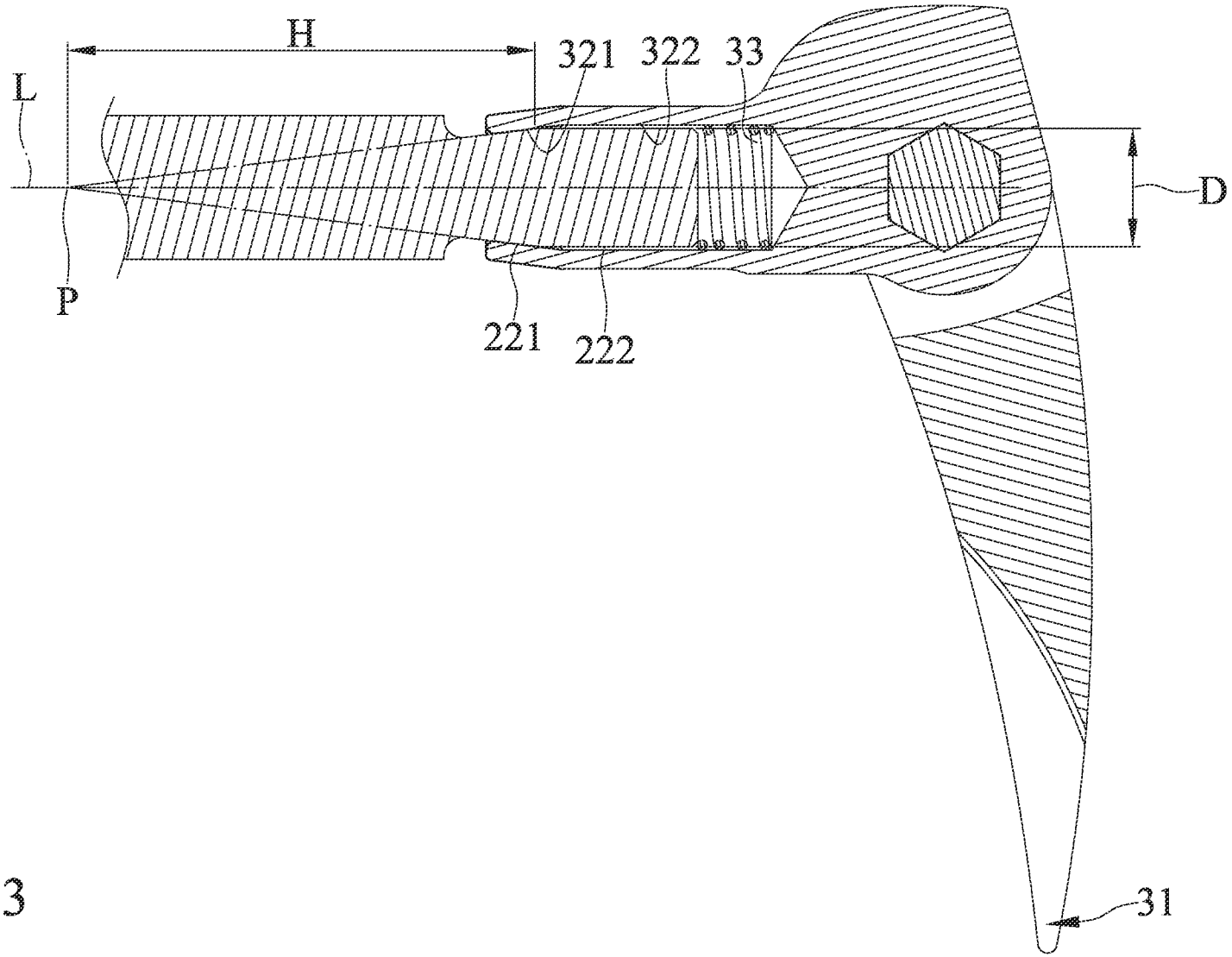
FIG. 3 is a cross-sectional view of the rotatable head of the dual-headed pry tool of FIG. 1 and shows the rotatable head in a first orientation.
Figure 4:
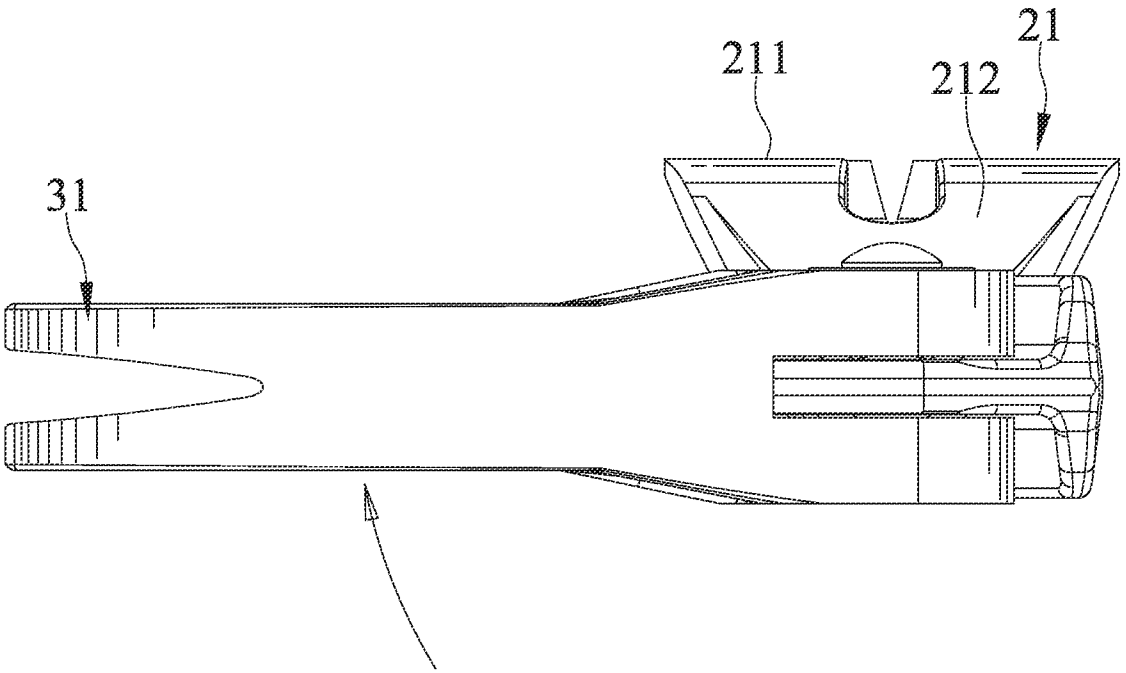
FIG. 4 is a side view of the rotatable head of the dual-headed pry tool of FIG. 1 and illustrates the rotatable head being rotatable by an arrow.
Figure 5:
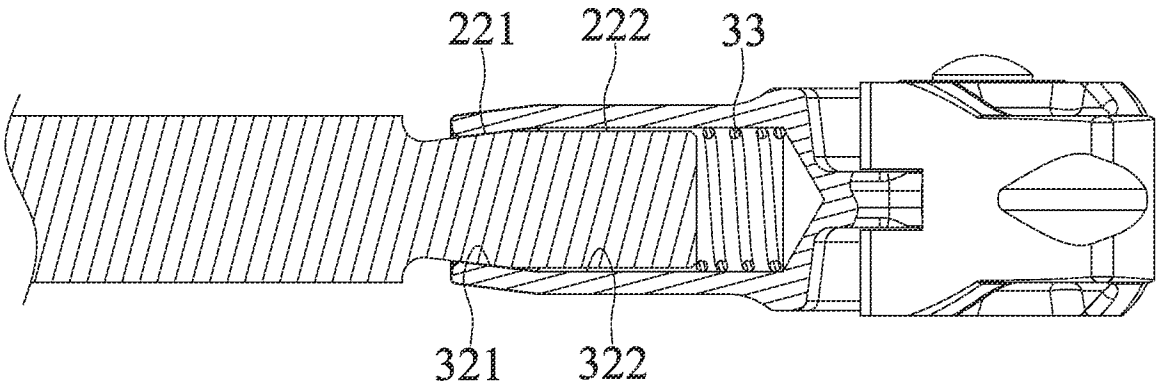
FIG. 5 is a cross-sectional view of the dual-headed pry tool of FIG. 1 and shows the rotatable head in a second orientation.
Figure 6:
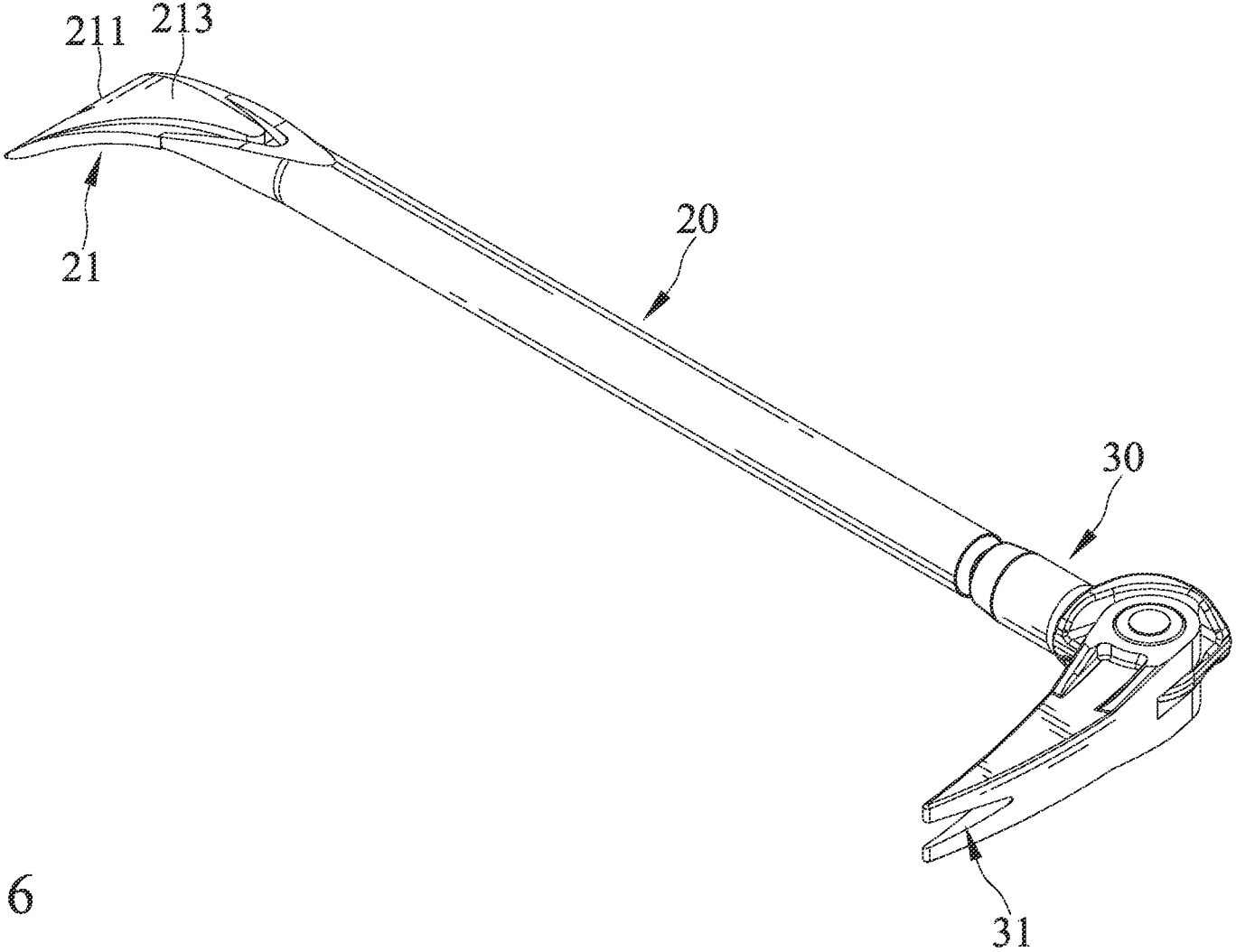
FIG. 6 is a perspective view of the dual-headed pry tool of FIG. 1 and shows the rotatable head in the second orientation.

FIGS. 1-6 show a dual-headed pry tool 10 with rotatable head according to the present invention. The dual-headed pry tool 10 includes a first tool component 20 and a second tool component 30 coupled with each other.

The first tool component 20 is provided with a first tool head 21 useful for prying objects at a first end thereof and a first pivot connection 22 at a second end thereof respectively. The first tool component 20 forms a shaft useful as a lever interconnecting the first tool head 21 and the first pivot connection 22. In the embodiment, the shaft is solid but can be hollow. The first tool head 21 is provided with an edge 211 at a distal end thereof which extends along a straight line, a pulling surface 212 at a first surface thereof configured to bear an object to be pried, and a supporting surface 213 at a second surface thereof, which is opposite the first surface, configured to abut against a surface to be pulled apart from the object to be pried. The edge 211 of the first tool head 21 is notched that is adapted for engaging with a nail to be pried. The pulling and the supporting surfaces 212 and 213 extend oppositely from the edge 211. The pulling surface 212 is concave. The supporting surface 213 is convex.

The second tool component 30 is provided with a second tool head 31 useful for prying objects at a first end thereof and a second pivot connection 32 at a second end thereof respectively. The second tool head 31 forms a claw. The second tool head 31 is notched that is adapted for engaging with a nail to be pried. The second pivot connection 32 is pivotally connected to the first pivot connection 22 to allow the first and the second tool components 20 and 30 to pivotally connect with each other. The second pivot connection 32 is provided with a hole. An inner periphery of the second pivot connection 32 defines the hole. The first pivot connection 22 is inserted and rotatable in the hole.

Further, the dual-headed pry tool 10 further includes mechanisms to prevent detachment between the first and the second pivot connections 22 and 32. The first pivot connection 22 is provided with a limiting section 221 and the second pivot connection 32 is provided with an anti-disengagement section 321 respectively. The limiting section 221 and the anti-disengagement section 321 abut against one another to prevent disengagement between the first and the second pivot connections 22 and 32. The limiting section 221 has a shape which has a small diameter end adjacent to the first tool head 21 and a large diameter end distal to the first tool head 21. The large diameter end of the limiting section 221 is of a diameter D. The shape of the limiting section 221 is conical. The limiting section 221 in cross section includes two lines, which extends along outer peripheral edges thereof and from the large diameter end toward the small diameter end, converging toward one another and intersecting at a vertex point P. The vertex point P is positioned at a distance from the large diameter end and the distance defines a height H. The ratio of the diameter D to the height H is more than 0.2 and less than 0.4. The anti-disengagement section 321 forms a conical hole corresponding to the shape of the limiting section 221. The anti-disengagement section 321 is shaped by applying an external force to an outer periphery of the second tool component 30 and deforms into a shape matching the limiting section 221. The anti-disengagement section 321 is on the inner periphery of the second pivot connection 32. The inner periphery of the second pivot connection 32, which defines the anti-disengagement section 321, is in surface contact with an outer periphery of the limiting section 221. Further, the second tool component 30 is provided with a resilient member 33 arranged in the hole defined by the second pivot connection 32 and opposite ends of the resilient member 33 respectively abut against the bottom of the hole of the second pivot connection 32 and the first pivot connection 22 to urge the limiting section 221 and the anti-disengagement section 321 to abut against one another. Further, In addition to the anti-disengagement section 321, the first pivot connection 22 is provided with a rod section 222 adjacent to the limiting section 221 and the rod section 222 is received by the second pivot connection 32. The hole of the second pivot connection 32 is provided with a tube section 322 in which the rod section 222 is disposed. The resilient member 33 abuts against the rod section 222 and disposed opposite the limiting section 221. The rod section 222 is cylindrical and the tube section 322 is circular.

The second tool component 30 is rotatable relative to the first tool component 20 about a pivot axis L which extends along a longitudinal direction between the first and the second ends of the first tool component 20. Each of the first and the second tool heads 21 and 31 has an orientation with respect to the pivot axis L, and a relative angle between the orientations of the first and the second tool heads 21 and 31 changes as the second tool component 30 rotates relative to the first tool component 20.

In view of the foregoing, a user can grip on the first tool component 20 to exert force, especially on the position close to the first tool head 21 in order to apply force more efficiently, and when using the second tool head 31 to pry an object, the second tool component 30 can be rotated to an orientation in which the second tool head 31 faces opposite a downward facing direction of the pulling surface 212 of the first tool head 21 (as shown in FIG. 1), the user can thus press on the supporting surface 213 in order to output force more efficiently and will not touch the edge 211 during the operation. On the other hand, the user does not need to worry about being scratched by the edge 211.

Although specific embodiments have been illustrated and described, numerous modifications and variations are still possible without departing from the scope of the invention. The scope of the invention is limited by the accompanying claims.

The invention claimed is:

1. An dual-headed pry tool with rotatable head comprising:

a first tool component provided with a first tool head useful for prying objects at a first end thereof and a first pivot connection at a second end thereof respectively; and a second tool component provided with a second tool head useful for prying objects at a first end thereof and a second pivot connection at a second end thereof respectively, wherein the second pivot connection is pivotally connected to the first pivot connection to allow the first and the second tool components to pivotally connect with each other, wherein the second tool component is rotatable relative to the first tool component about a pivot axis which extends along a longitudinal direction between the first and the second ends of the first tool component, and wherein each of the first and the second tool heads has an orientation with respect to the pivot axis, and a relative angle between the orientations of the first and the second tool heads changes as the second tool component rotates relative to the first tool component, wherein the second pivot connection is provided with a hole, wherein an inner periphery of the second pivot connection defines the hole, wherein the first pivot connection is inserted and rotatable in the hole, wherein the first pivot connection is provided with a limiting section and the second pivot connection is provided with an anti-disengagement section respectively, wherein the limiting section and the anti-disengagement section abut against one another to prevent disengagement between the first and the second pivot connections, wherein the limiting section has a shape which has a small diameter end adjacent to the first tool head and a large diameter end distal to the first tool head, and wherein the anti-disengagement section is on the inner periphery of the second pivot connection.

2. The dual-headed pry tool as claimed in claim 1, wherein the shape of the limiting section is conical, wherein the large diameter end of the limiting section is of a diameter, wherein the limiting section in cross section includes two lines, which extends along outer peripheral edges thereof and from the large diameter end toward the small diameter end, converging toward one another and intersecting at a vertex point, wherein the vertex point is positioned at a distance from the large diameter end and the distance defines a height, and wherein the ratio of the diameter to the height is more than 0.2 and less than 0.4.

3. The dual-headed pry tool as claimed in claim 2, wherein the anti-disengagement section forms a conical hole corresponding to the shape of the limiting section, and wherein the inner periphery of the second pivot connection, which defines the anti-disengagement section, is in surface contact with an outer periphery of the limiting section.

4. The dual-headed pry tool as claimed in claim 1, wherein the second tool component is provided with a resilient member arranged in the hole defined by the second pivot connection and opposite ends of the resilient member respectively abut against a bottom of the hole of the second pivot connection and the first pivot connection to urge the limiting section and the anti-disengagement section to abut against one another.

5. The dual-headed pry tool as claimed in claim 4, wherein the first pivot connection is provided with a rod section adjacent to the limiting section and the rod section is received by the second pivot connection, wherein the hole of the second pivot connection is provided with a tube section in which the rod section is disposed, and wherein the resilient member abuts against the rod section and disposed opposite the limiting section.

6. The dual-headed pry tool as claimed in claim 5, wherein the rod section is cylindrical and the tube section is circular.

7. The dual-headed pry tool as claimed in claim 1, wherein the anti-disengagement section is shaped by applying an external force to an outer periphery of the second tool component and deforms into a shape matching the limiting section.

8. The double-headed prying tool with rotatable head as claimed in claim 1, wherein the first tool head is provided with an edge at a distal end thereof which extends along a straight line, a pulling surface at a first surface thereof configured to bear an object to be pried, and a supporting surface at a second surface thereof, which is opposite the first surface, configured to abut against a surface to be pulled apart from the object to be pried, and wherein the pulling and the supporting surfaces extend oppositely from the edge.

9. The double-headed prying tool with rotatable head as claimed in claim 8, wherein the pulling surface is concave, and wherein the supporting surface is convex.

10. The double-headed prying tool with rotatable head as claimed in claim 8, wherein the edge of the first tool head is notched.

11. The dual-headed pry tool with rotatable head as claimed in claim 9, wherein the second tool head forms a claw.

12. The dual-headed pry tool with rotatable head as claimed in claim 11, wherein the second tool head is notched.

13. The dual-headed pry tool with rotatable head as claimed in claim 1, wherein the first tool component forms a shaft useful as a lever interconnecting the first tool head and the first pivot connection.

* * * * *